US008123542B2

(12) United States Patent
Kimura et al.

(10) Patent No.: US 8,123,542 B2
(45) Date of Patent: Feb. 28, 2012

(54) CONTACT AND CONNECTOR INCLUDING THE CONTACT

(75) Inventors: Masaki Kimura, Tokyo (JP); Nobukazu Kato, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/496,397

(22) Filed: Jul. 1, 2009

(65) Prior Publication Data

US 2010/0003869 A1 Jan. 7, 2010

(30) Foreign Application Priority Data

Jul. 4, 2008 (JP) ..... 2008-176358

(51) Int. Cl.
*H01R 13/62* (2006.01)

(52) U.S. Cl. ..... 439/326; 439/637

(58) Field of Classification Search ..... 439/326, 439/328, 637, 636
See application file for complete search history.

(56) References Cited

U.S. PATENT DOCUMENTS

| | | | | |
|---|---|---|---|---|
| 5,514,002 | A * | 5/1996 | Cheng et al. | 439/326 |
| 5,791,925 | A * | 8/1998 | Yu | 439/326 |
| 6,183,283 | B1 * | 2/2001 | Kurotori et al. | 439/326 |
| 6,666,702 | B1 * | 12/2003 | Pickles | 439/328 |
| 2004/0152352 | A1 * | 8/2004 | Tsai | 439/326 |
| 2007/0173127 | A1 * | 7/2007 | Regnier et al. | 439/637 |

FOREIGN PATENT DOCUMENTS

JP 2005-525684 A 8/2005

* cited by examiner

*Primary Examiner* — Hien Vu
(74) *Attorney, Agent, or Firm* — Holtz, Holtz, Goodman & Chick, PC

(57) ABSTRACT

A contact capable of facilitating adjustment of impedance and ensuring a high holding force when held in a housing. To a contact portion capable of being brought into contact with a pad on a module substrate, a spring portion is connected for pressing the contact portion against the pad. A press-fitting portion that is press-fitted into the housing is connected to the spring portion, and has a connecting portion connected thereto. A terminal portion to be connected to a pad on a motherboard is connected to the connecting portion. The spring portion is bent in a manner folded back from the rear end of the press-fitting portion in the inserting direction, toward a front side in the inserting direction. The connecting portion extends from the rear end of the press-fitting portion in the inserting direction, toward a rear side in the inserting direction.

1 Claim, 5 Drawing Sheets

CONTACT AND CONNECTOR INCLUDING THE CONTACT

BACKGROUND OF THE INVENTION

1. Field of the Invention

This invention relates to a contact and a connector including the same.

2. Description of the Related Art

Conventionally, there has been disclosed a conductive terminal (contact) including a contact portion, a mounting portion, a body portion connecting the contact portion and the mounting portion, and a holding portion disposed between the contact portion and the mounting portion (see e.g. Japanese PCT application translation Publication No. 2005-525684).

The conductive terminal is inserted into a housing from a rear side of the housing, whereby the holding portion of the conductive terminal is held in the housing.

The holding portion of the conductive terminal extends in the inserting direction of the conductive terminal. Further, the holding portion has an opening and a slot extending in the inserting direction of the conductive terminal, for adjusting the impedance of the conductive terminal.

The connector including the above-described conductive terminal suffers from the problem that the holding portion of the conductive terminal is formed with the opening and the slot, as described above, and hence the holding force of the holding portion for holding the conductive terminal in the housing is weak. Therefore, there is a fear that the conductive terminal moves from a predetermined position in the housing or comes off the housing due to some cause. Further, the holding portion forms a stub, which makes it difficult to obtain desired impedance. In designing a terminal such that a desired impedance is obtained, it is troublesome to adjust the impedance.

SUMMARY OF THE INVENTION

The present invention has been made in view of these circumstances, and an object thereof is to provide a contact which is capable of facilitating the adjustment of impedance and ensuring a high holding force when the contact is held in a housing, and a connector including the contact.

To attain the above object, in a first aspect of the present invention, there is provided a contact comprising a contact portion that is capable of being brought into contact with one object to be connected, a press-fitting portion that is press-fitted into a housing, a connecting portion connected to said press-fitting portion, said connecting portion extending from a rear end of said press-fitting portion in an inserting direction of said press-fitting portion, toward a rear side in the inserting direction, a spring portion connected to said contact portion for pressing said contact portion against the one object to be connected, said spring portion having said press-fitting portion connected thereto, and being bent in a manner folded back from said rear end of said press-fitting portion in the inserting direction toward a front side in the inserting direction, and a terminal portion connected to said connecting portion, for being connected to the other object to be connected.

With the arrangement of the contact according to the present invention, as described above, the spring portion is bent in a manner folded back from the rear end of the press-fitting portion in the inserting direction toward the front side in the inserting direction, and the connecting portion extends from the rear end of the press-fitting portion in the inserting direction of the press-fitting portion toward the rear side in the inserting direction. This makes it possible to reduce the size of the press-fitting portion in the inserting direction. As a consequence, it is not necessary to form openings or slots in the press-fitting portion.

Preferably, said press-fitting portion has a protrusion that bites into the housing when said press-fitting portion is press-fitted into the housing.

Preferably, said press-fitting portion is a substantially rectangular plate portion extending in a direction orthogonal to the inserting direction of said press-fitting portion and a direction of thickness of said press-fitting portion.

More preferably, a connecting end of said spring portion via which said spring portion is connected to said press-fitting portion is positioned toward one longitudinal end of said press-fitting portion; a connecting end of said connecting portion via which said connecting portion is connected to said press-fitting portion is positioned toward the other longitudinal end of said press-fitting portion; and said connecting portion and said spring portion are arranged with a predetermined gap therebetween.

Preferably, the contact is formed by pressing a metal plate.

In a second aspect of the present invention, there is provided a connector including the contact described above.

According to the present invention, it is possible to facilitate the adjustment of impedance, and ensure a high holding force when the contact is held in the housing.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

First, a connector including a contact according to an embodiment of the present invention will be described with reference to FIGS. 1A to 3.

The connector is a card edge connector for connecting a module substrate (one object to be connected), such as a graphic card substrate, not shown, to a motherboard (the other object to be connected) e.g. of a personal computer or a printer, and more particularly a narrow-pitch card edge connector compatible with high-speed signals.

Figure 1A:
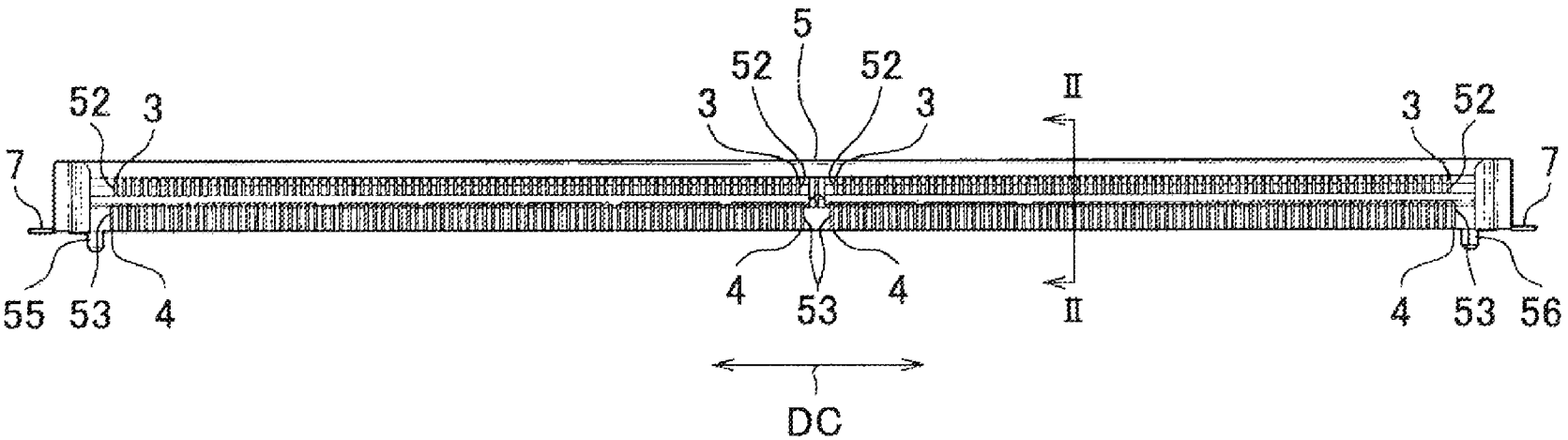
FIG. 1A is a front view of contacts and a connector including the same, according to an embodiment of the present invention.
Figure 1B:
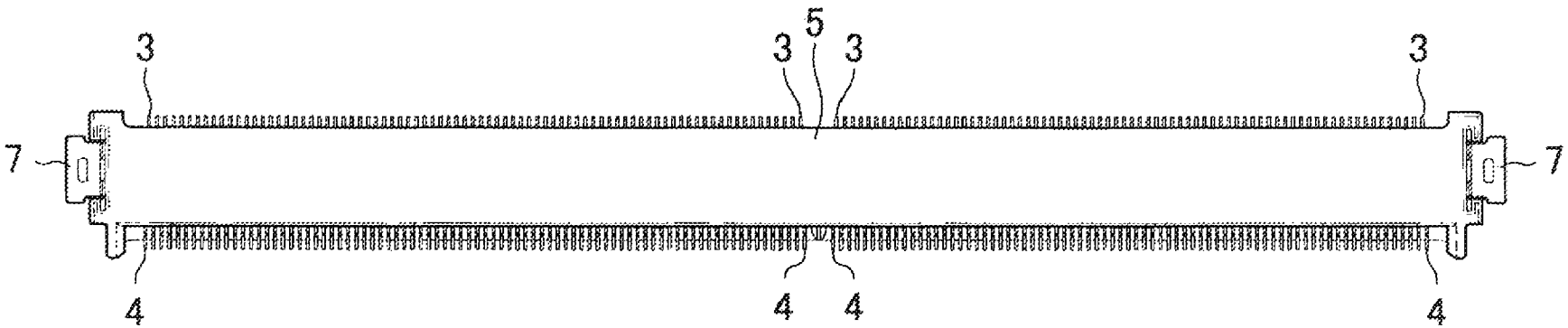
FIG. 1B is a plan view of the connector shown in FIG. 1A.
Figure 1C:
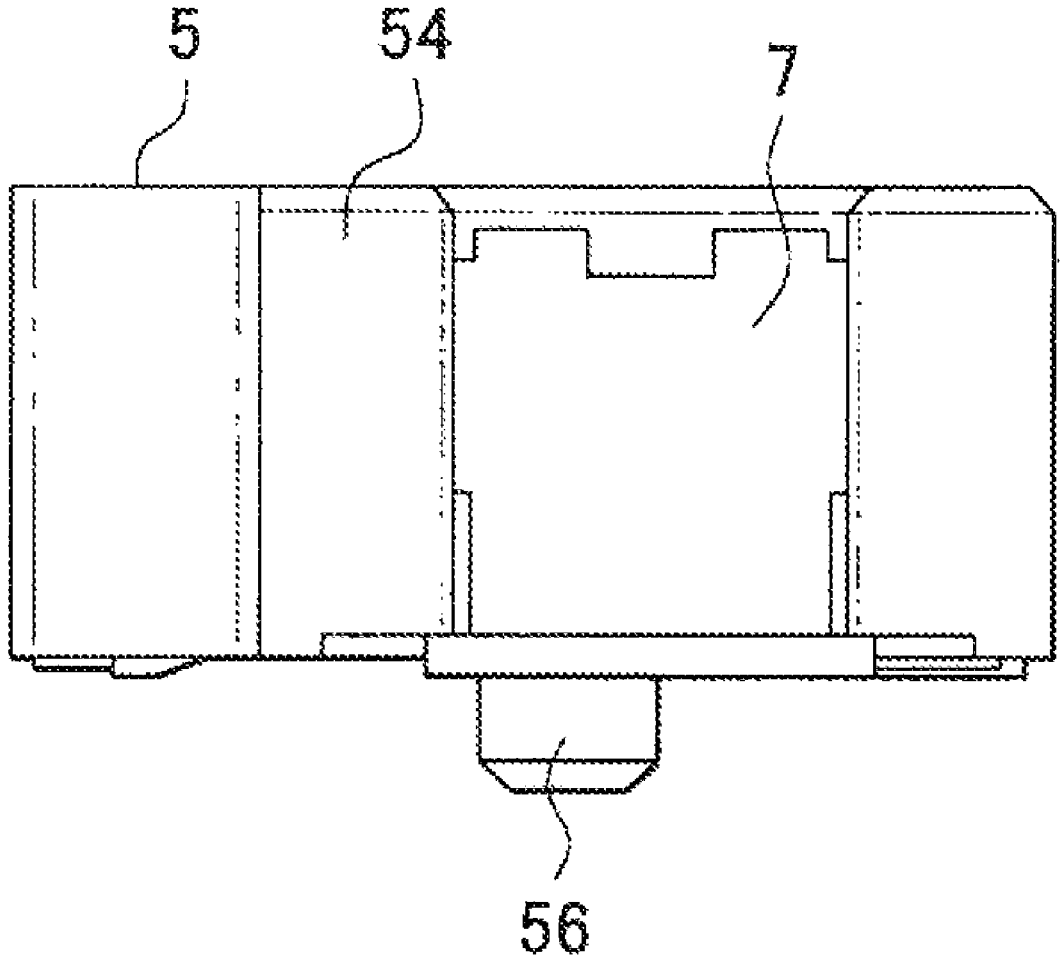
FIG. 1C is an enlarged side view of the connector shown in FIG. 1A.

Referring to FIGS. 1A, 1B and 1C, the connector is comprised of upper contacts (contact) 3, lower contacts 4 and a housing 5.

Figure 2:
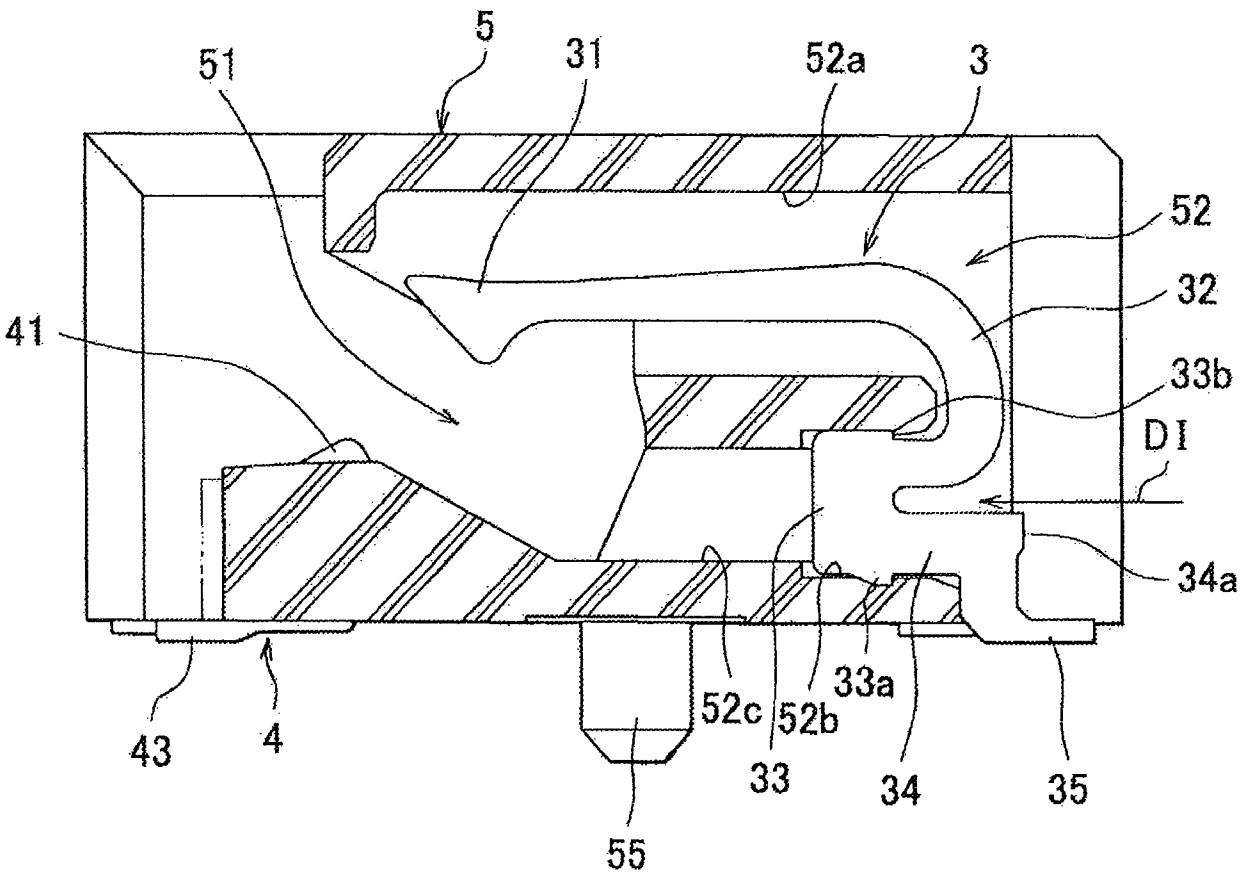
FIG. 2 is an enlarged cross-sectional view taken on line II-II of FIG. 1A.
Figure 3:
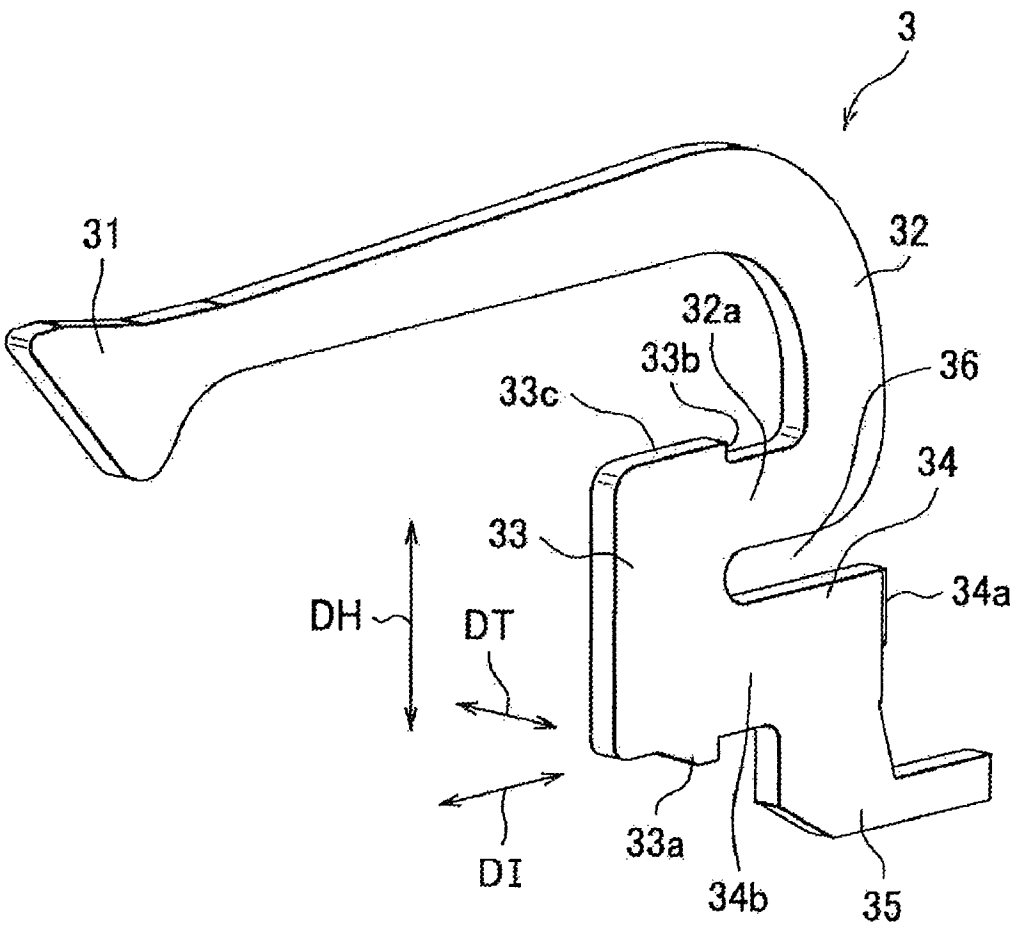
FIG. 3 is a perspective view of an upper contact appearing in FIG. 2.

As shown in FIGS. 2 and 3, each upper contact 3 includes a contact portion 31, a spring portion 32, a press-fitting portion 33, a connecting portion 34, and a terminal portion 35. The upper contact 3 is formed by pressing a metal plate (not shown).

The contact portion 31 is brought into contact with a pad (not shown) formed on the upper surface of the module substrate.

The spring portion 32 is substantially J-shaped, and has one end thereof connected to the contact portion 31. The spring portion 32 presses the contact portion 31 against the pad formed on the upper surface of the module substrate.

The press-fitting portion 33 has a substantially rectangular shape. More specifically, the press-fitting portion 33 is a substantially rectangular and elongated plate extending in a direction DH (direction of the height of the press-fitting portion 33) orthogonal to a direction DI in which the press-fitting portion 33 is inserted into a holding hole portion 52*b*, referred to hereinafter, of the housing 5, and a direction DT of the thickness of the press-fitting portion 33. The direction DH of the height of the press-fitting portion 33 is parallel to the longitudinal direction of the press-fitting portion 33. The press-fitting portion 33 has a lower portion formed with a substantially wedge-shaped protrusion 33*a*. The other end (connecting end) of the spring portion 32 is connected to an upper portion of a rear end 33*b* of the press-fitting portion 33 in the inserting direction DI of the press-fitting portion 33. The other end of the spring portion 32 extends in a direction opposite to the inserting direction DI, from an upper end surface 33*c* of the press-fitting portion 33, with a portion stepped downward therefrom. The contact portion 31 is positioned forward of the press-fitting portion 33 in the inserting direction DI, and upward of the press-fitting portion 33 in the direction DH of the height thereof. The spring portion 32 is bent from the rear end 33*b* of the press-fitting portion 33 in the inserting direction DI in a manner folded back toward a front side in the inserting direction DI. The press-fitting portion 33 is press-fitted into an associated one of the holding hole portions 52*b* of the housing 5. When the press-fitting portion 33 is press-fitted into the associated holding hole portion 52*b*, the protrusion 33*a* bites into the inner surface of the holding hole portion 52*b*, which makes the press-fitting portion 33 difficult to be pulled out from the holding hole portion 52*b*.

The connecting portion 34 has a substantially rectangular shape. One end (connecting end) of the connecting portion 34 is connected to a lower portion of the rear end 33*b* of the press-fitting portion 33 in the inserting direction DI. The connecting portion 34 is a substantially rectangular and horizontally oriented plate extending in the inserting direction DI. The connecting portion 34 has a connection mark 34*a* indicating that the connecting portion 34 was connected to a carrier (not shown). The connecting portion 34 and the spring portion 32 are arranged with a predetermined gap 36 therebetween.

The terminal portion 35 is substantially L-shaped, and is connected to the other end of the connecting portion 34. The terminal portion 35 is soldered to a pad (not shown) on the motherboard.

The width of the spring portion 32 in the direction DH of the height thereof and the width of the connecting portion 34 in the direction DH of the height thereof are substantially equal to each other.

Further, the width of the press-fitting portion 33 in the inserting direction DI and the width of the connecting portion 34 in the direction DH of the height thereof are substantially equal to each other.

As shown in FIG. 2, each lower contact 4 has a contact portion 41, a terminal portion 43, and so forth.

The contact portion 41 is brought into contact with a pad (not shown) formed on the lower surface of the module substrate.

The terminal portion 43 is soldered to a pad (not shown) on the motherboard.

Since the lower contact 4 is by far smaller than the upper contact 3, the impedance matching therebetween does not present a serious problem. The lower contact 4 does not have such a press-fitting portion, a spring portion, and the like, as shaped in the upper contact 3.

The housing 5 is made of a resin having insulation properties. As shown in FIG. 2, the housing 5 has a receiving portion 51 formed in a front portion thereof. The receiving portion 51 receives a front end of the module substrate. The front end of the module substrate is configured to be pivotally movable in the receiving portion 51 about the contact portions 41 within a predetermined range of angles.

A plurality of first contact-accommodating chambers 52 are formed at equally-spaced intervals in a rear portion of the left half of the housing 5 (the left half of the housing 5 as viewed in FIG. 1A) and a rear portion of the right half of the housing 5 (the right half of the housing 5 as viewed in FIG. 1A) in a contact arrangement direction DC. A front portion of each first contact-accommodating chamber 52 communicates with the receiving portion 51, and a rear portion thereof faces the outside of the housing 5. The first contact-accommodating chamber 52 includes a spring portion-accommodating portion 52*a*, the holding hole portion 52*b* and a hollow portion 52*c*. The spring portion-accommodating portion 52*a* accommodates an associated one of the spring portions 32 of the upper contact 3, and has a capacity large enough not to hinder the elastic deformation of the accommodated spring portion 32. Each press-fitting portion 33 of the upper contact 3 is press-fitted into an associated one of the holding hole portions 52*b* along the inserting direction DI. When the press-fitting portions 33 are inserted into the holding hole portions 52*b*, the upper contacts 3 are held in the housing 5. Each hollow portion 52*c* is interposed between an associated one of the holding hole portions 52*b* and the receiving portion 51.

Referring to FIG. 1A, second contact-accommodating chambers 53 are formed at equally-spaced intervals in a front portion of the left half of the housing 5 and a front portion of the right half thereof in the contact arrangement direction DC. Although the arrangement pitch of the second contact-accommodating chambers 53 is equal to the arrangement pitch of the first contact-accommodating chambers 52, the second contact-accommodating chambers 53 and the first contact-accommodating chambers 52 are displaced from each other in the contact arrangement direction DC by half the arrangement pitch. Each lower contact 4 is accommodated in an associated one of the second contact-accommodating chambers 53.

As shown in FIGS. 1A, 1B and 1C, the opposite ends of the housing 5 in the longitudinal direction thereof are formed with holddown-mounting portions 54, respectively. Holddowns 7 are mounted on the holddown-mounting portions 54, respectively.

A positioning boss 55 is formed on a lower surface of one longitudinal end of the housing 5, and a positioning boss 56 is formed on a lower surface of the other longitudinal end of the housing 5. The positioning boss 55 is thinner than the positioning boss 56.

Next, a description will be given of an example of a method of using the above connector.

First, the respective terminal portions 35 of the upper contacts 3, the respective terminal portions 43 of the lower contacts 4, and the holddowns 7 are soldered to pads on the motherboard, respectively, to thereby mount the connector on the motherboard.

Next, the front end of the module substrate is obliquely inserted into the receiving portion 51 of the connector. After the insertion, the module substrate is pivotally moved about the respective contact portions 41 of the lower contacts 4 such that the front end of the module substrate is moved upward. When the module substrate becomes substantially parallel to the motherboard, the module substrate is brought into abutment with partition walls of the first contact-accommodating chambers 52 whereby the pivotal motion of the module substrate is stopped. In this state, each spring portion 32 is pressed upward by the front end of the module substrate to be elastically deformed, and the contact portion 31 of each upper contact 3 is pressed against an associated one of the pads on the upper surface of the module substrate by the spring force of the spring portion 32. Further, the contact portion 41 of each lower contact 4 is in contact with an associated one of the pads formed on the lower surface of the module substrate.

As a consequence, the module substrate and the motherboard are electrically connected to each other via the upper contacts 3 and lower contacts 4 of the connector.

Further, as described above, the spring portion 32 of each upper contact 3 is bent in a manner folded back from the rear end 33*b* of each press-fitting portion 33 in the inserting direction DI toward the front side in the inserting direction DI, and the connecting portion 34 of the upper contact 3 extends from the rear end 33*b* of the press-fitting portion 33 in the inserting direction DI toward the rear side in the inserting direction DI, whereby the connector is configured to prevent the press-fitting portions 33 from forming stubs. This enables reduction of the size of each press-fitting portion 33 in the inserting direction DI. As a consequence, it is not necessary to form an opening or a slot in the press-fitting portion 33.

According to the present embodiment, since the press-fitting portion 33 is prevented from forming a stub, it is possible to facilitate the adjustment of impedance of the contact 3. Further, since there is no need to form any opening or slot in the press-fitting portion 33, it is possible to ensure a high holding force when the contact 3 is held in the housing 5.

As described hereinabove, according to the present embodiment, it is possible to facilitate the adjustment of impedance of the contact 3 and ensure a high holding force when the contact 3 held in the housing 5.

Further, in designing a contact such that a desired impedance is obtained, it is possible to facilitate the adjustment of the impedance.

It should be noted that although in the present embodiment, the contacts are provided for a board-to-board connector, the scope of application of the present invention is not limited to the board-to-board connector.

It is further understood by those skilled in the art that the foregoing are the preferred embodiments of the present invention, and that various changes and modification may be made thereto without departing from the spirit and scope thereof.

What is claimed is:

1. A connector comprising:

a contact formed by press working a single metal plate, the contact comprising:

a contact portion that is capable of being brought into contact with one substantially plate-shaped object to be connected that has been inserted into a front part of a housing;

a press-fitting portion that is press-fitted from a rear of the housing into a rear end part of the housing;

a connecting portion connected to a lower portion of the press-fitting portion, the connecting portion extending from a rear end part of the press-fitting portion in an inserting direction of the press-fitting portion, toward a rear side in the inserting direction, without being press-fitted into the housing;

a spring portion connected to the contact portion for pressing the contact portion against the one object to be connected, the spring portion being connected to an upper portion of the press-fitting portion, and being bent curvingly in a manner folded back from the rear end part of the press-fitting portion in the inserting direction toward a front side in the inserting direction, without being press-fitted into the housing; and a terminal portion to be connected to another substantially plate-shaped object to be connected on which the housing is disposed;

wherein the press-fitting portion comprises a substantially rectangular plate portion extending in a direction orthogonal to the inserting direction of the press-fitting portion and to a thickness direction of the press-fitting portion;

wherein a connecting end of the spring portion via which the spring portion is connected to the press-fitting portion is positioned toward a first longitudinal end of the press-fitting portion, a connecting end of the connecting portion via which the connecting portion is connected to the press-fitting portion is positioned toward a second longitudinal end of the press-fitting portion, and the connecting portion and the spring portion are arranged with a predetermined gap therebetween; and wherein the press-fitting portion includes a protrusion at the lower portion of the press-fitting portion in a vicinity of the rear end part of the press-fitting portion adjacent to the connection portion, and the protrusion bites into the housing when the press-fitting portion is press-fitted into the housing.

* * * * *

UNITED STATES PATENT AND TRADEMARK OFFICE

CERTIFICATE OF CORRECTION

PATENT NO. : 8,123,542 B2
APPLICATION NO. : 12/496397
DATED : February 28, 2012
INVENTOR(S) : Masaki Kimura et al.

It is certified that error appears in the above-identified patent and that said Letters Patent is hereby corrected as shown below:

Column 6, Line 50, Claim 1, Line 44:

change “the connection portion” to -- the connecting portion--.

Signed and Sealed this
Tenth Day of July, 2012

David J. Kappos

David J. Kappos
*Director of the United States Patent and Trademark Office*